US006354571B1

(12) United States Patent
Gerhardy

(10) Patent No.: US 6,354,571 B1
(45) Date of Patent: Mar. 12, 2002

(54) MEMBRANE CARBURETOR

(75) Inventor: Reinhard Gerhardy, Korb (DE)

(73) Assignee: Andreas Stihl AG & Co., Waiblingen (DE)

( * ) Notice: Subject to any disclaimer, the term of this patent is extended or adjusted under 35 U.S.C. 154(b) by 0 days.

(21) Appl. No.: 09/654,881

(22) Filed: Sep. 5, 2000

(30) Foreign Application Priority Data

Sep. 2, 1999 (DE) ..... 199 41 697

(51) Int. Cl.[7] ..... F02M 17/04

(52) U.S. Cl. ..... 261/35; 261/37; 261/69.1; 261/DIG. 68

(58) Field of Search ..... 261/35, 37, 69.1, 261/69.2, DIG. 8, DIG. 68

(56) References Cited

U.S. PATENT DOCUMENTS

| | | | | |
|---|---|---|---|---|
| 4,447,370 A | * | 5/1984 | Kobayashi et al. | 261/DIG. 68 |
| 4,455,266 A | * | 6/1984 | Gerhardy | 261/DIG. 68 |
| 4,563,311 A | * | 1/1986 | Agnew | 261/35 |
| 4,578,228 A | * | 3/1986 | Gerhardy | 261/DIG. 68 |
| 5,441,673 A | * | 8/1995 | Gerhardy | 261/35 X |
| 5,711,901 A | | 1/1998 | Berg et al. | 261/35 |
| 5,891,369 A | * | 4/1999 | Tuggle et al. | 261/DIG. 8 |
| 6,059,271 A | * | 5/2000 | Gerhardy | 261/35 |
| 6,149,139 A | * | 11/2000 | Holderle | 261/69.1 X |
| 6,234,458 B1 | * | 5/2001 | Gerhardy | 261/DIG. 68 |
| 6,247,681 B1 | * | 6/2001 | Gerhardy | 261/35 |

FOREIGN PATENT DOCUMENTS

| | | |
|---|---|---|
| EP | 0 786 591 | 7/1997 |
| JP | 61 201877 | 9/1986 |

* cited by examiner

*Primary Examiner*—Richard L. Chiesa
(74) *Attorney, Agent, or Firm*—Walter Ottesen

(57) ABSTRACT

A membrane carburetor (1) for an internal combustion engine includes a control chamber (2) delimited by a membrane. The control chamber (2) is connected via a feed line (8) to a fuel tank (9). The feed line (8) is cleared with the deflection of the membrane (3) because of underpressure in the control chamber (2). The control chamber (2) is connected via at least one intake opening (16, 17) with an air-intake channel (14) to the engine. As start-assist devices for the engine, a scavenging pump (10) and an injection pump (20) are provided. The scavenging pump (10) is provided in a return line (13) between the control chamber (2) and the fuel tank (9). The fuel can be pumped into the air-intake channel (14) with a displacement piston (21) of the injection pump (20). The displacement piston (21) is longitudinally guided in a cylinder (22) and delimits a pump chamber (24). The pump chamber (24) is connected via an injection line (30) to a feed (18) of the intake openings (16, 17). The piston stroke of the displacement piston (21) is limited by a stop (26) which is adjusted in stroke direction (31) by an adjusting element (23) in dependence upon temperature. This arrangement ensures a reliable start of the engine with an easy operability of the start-assist devices.

10 Claims, 1 Drawing Sheet

MEMBRANE CARBURETOR

FIELD OF THE INVENTION

The invention relates to a membrane carburetor for an internal combustion engine having a start-assist device.

BACKGROUND OF THE INVENTION

In a membrane carburetor for an internal combustion engine, a control chamber of the engine is delimited by a membrane and is connected to a fuel tank of a work apparatus via a feed line. The engine is preferably a drive unit for a portable handheld work apparatus such as a motor-driven chain saw and the like. The control chamber is filled with fuel during operation of the engine and is connected via at least one intake opening to an air-intake channel of the carburetor to the engine. An underpressure arises in the control chamber because of the removal of fuel. This deflects the membrane whereby the feed line can be cleared. Conventionally, a check valve is arranged in a feed of the intake openings. This check valve prevents a penetration of fuel or of the air/fuel mixture from the air-intake channel into the control chamber.

For a membrane carburetor of this type, European patent publication 0,786,591 suggests a start-assist device which includes a scavenging pump and an injection pump. The scavenging pump is in a return line between the control chamber and the fuel tank. The control chamber can be flooded with fuel in advance of starting the engine by actuating the scavenging pump. In the known arrangement, the scavenging pump is mounted in the feed line to the control chamber. The injection pump includes a displacement piston which can be pressed into the control chamber whereby fuel from the filled control chamber is pressed through the intake openings into the air-intake channel. The displacement piston is coupled to an additional membrane which delimits the control chamber and reduces the volume of the control chamber when the rod is pressed in. A quantity of fuel, which corresponds to the volume reduction, is injected into the air-intake channel. In this way, and before the engine is taken into service (that is, before the engine can develop a suction action), fuel is made available in the air-intake channel in order to ensure the first ignitions of the engine.

Furthermore, a membrane carburetor is known wherein the scavenging pump is mounted in the return line between the control chamber and the fuel tank (see Walbro WYK Carburetor, Service Manual 1994). An underpressure can be generated in the control chamber with the scavenging pump. The air is pumped out of the control chamber in preparation for the start and the control membrane opens the fuel feed line because of its deflection when there is an underpressure so that fuel flows into the control chamber. This flooding operation of the control chamber in preparation for the start of the engine is also known as purging. The scavenging pump includes an elastic purging bellows which can be pressed inwardly. The injection pump of the known WYK membrane carburetor includes a pin-like displacement piston which can be pressed into the fuel filled control chamber in order to inject fuel into the air-intake channel. The injection operation by pressing in the displacement piston takes place after flooding of the control chamber by purging and is also known as "priming".

A metering of the priming fuel quantity to be injected is necessary in order to start the operation of the engine without difficulty and to ensure a runup until the suction action of the engine automatically draws the fuel from the control chamber into the air-intake channel. In the known carburetors, and for starting the engine, substantial experience of the operator is required in order to meter the fuel quantity, which is to be injected with the injection pump. Most often, too little fuel is injected so that the runup of the engine is not ensured and the engine goes to standstill after only a few revolutions. Furthermore, often too much fuel is metered so that an overenriched mixture is present in the engine.

SUMMARY OF THE INVENTION

It is an object of the invention to improve a membrane carburetor of the kind described above so that a reliable start of the engine is ensured with only simple manipulative handling by the operator.

The membrane carburetor of the invention is for an internal combustion engine including an engine for a portable handheld work apparatus. The engine includes a fuel tank, a fuel feed line connected to the tank and a fuel return line also connected to the tank. The membrane carburetor includes: a carburetor housing defining an air-intake channel communicating with the engine and through which a stream of air flowing in an intake direction is drawn by suction when the engine is operating; the carburetor housing including a control chamber connected to the fuel-feed line and to the return line; a membrane arranged in the carburetor housing and mounted therein so as to delimit the control chamber; a valve assembly operatively connected to the membrane for clearing the fuel feed line in response to a deflection of the membrane in response to an underpressure in the control chamber; an intake passage for connecting the control chamber to the air-intake channel and for conducting fuel thereto; the intake channel including outlet means opening into the air-intake channel; a check valve mounted in the intake passage; a scavenging pump defining a first start-assist device and being connected in the fuel return line between the control chamber and the fuel tank; an injection pump defining a second start-assist device; the injection pump including: a cylinder and a displacer piston delimiting a pump chamber into which fuel can flow; an injection line connecting the pump chamber to the intake passage; the displacer piston being longitudinally movable in the cylinder through a piston stroke for pumping fuel in the pump chamber through the injection line, the outlet means and into the air-intake channel; the injection pump further including: a stop for limiting the piston stroke; and, an adjusting element having a shape changing in dependence upon temperature to determine the length of the piston stroke.

According to the invention, the displacement piston of the injection pump is guided longitudinally in a cylinder and delimits therein a pump chamber which is connected to the feed of the intake openings via an injection line. The piston stroke of the displacement piston is delimited by a stop and is determined with respect to its length by the temperature-dependent configuration of an adjusting element. Depending upon the particular temperature, the maximum piston stroke and therefore the pump chamber volume is defined. During priming, it is provided that the entire pump chamber volume is pressed out by the displacement piston and injected into the carburetor air-intake channel for preparing the engine for starting. When operating the injection pump, the displacement piston is to be displaced in each case up to the stop whereby the simplest operability is ensured for precise temperature-dependent metering of the priming fuel quantity.

Bimetal elements are preferably provided as temperature-dependent actuating elements for the stop. The bimetal elements assume predictably different expansions and alignments in correspondence to their temperature. In an advantageous configuration of the invention, the displacement piston is mounted on the free end of a rod which can be pressed into the cylinder of the injection pump. A cylinder head plate forms the stop and the bimetal element is mounted between the displacement piston and the cylinder head. The cylinder head plate covers the cylinder and the rod extends through this plate. The bimetal element can be expanded in the stroke direction. The bimetal element is advantageously formed by a plate spring packet of bimetal plate springs connected in series.

The injection line of the injection pump advantageously opens into the feed of the intake openings of the carburetor air-intake channel next to and downstream of the check valve. In this way, the movable valve member of the check valve is wetted with fuel in advance of starting the engine. Thus, an unwanted sticking of the valve member to its valve seat is countered and the proper opening of the check valve is enabled when there is suction pressure present in the air-intake channel. The above problem of the valve member sticking to its valve seat occurs especially after the engine has been at standstill a very long time.

BRIEF DESCRIPTION OF THE DRAWINGS

The invention will now be described with respect to the single FIGURE (FIG. 1) of the drawing which is a schematic of a membrane carburetor according to the invention.

DESCRIPTION OF THE PREFERRED EMBODIMENTS OF THE INVENTION

Figure 1:
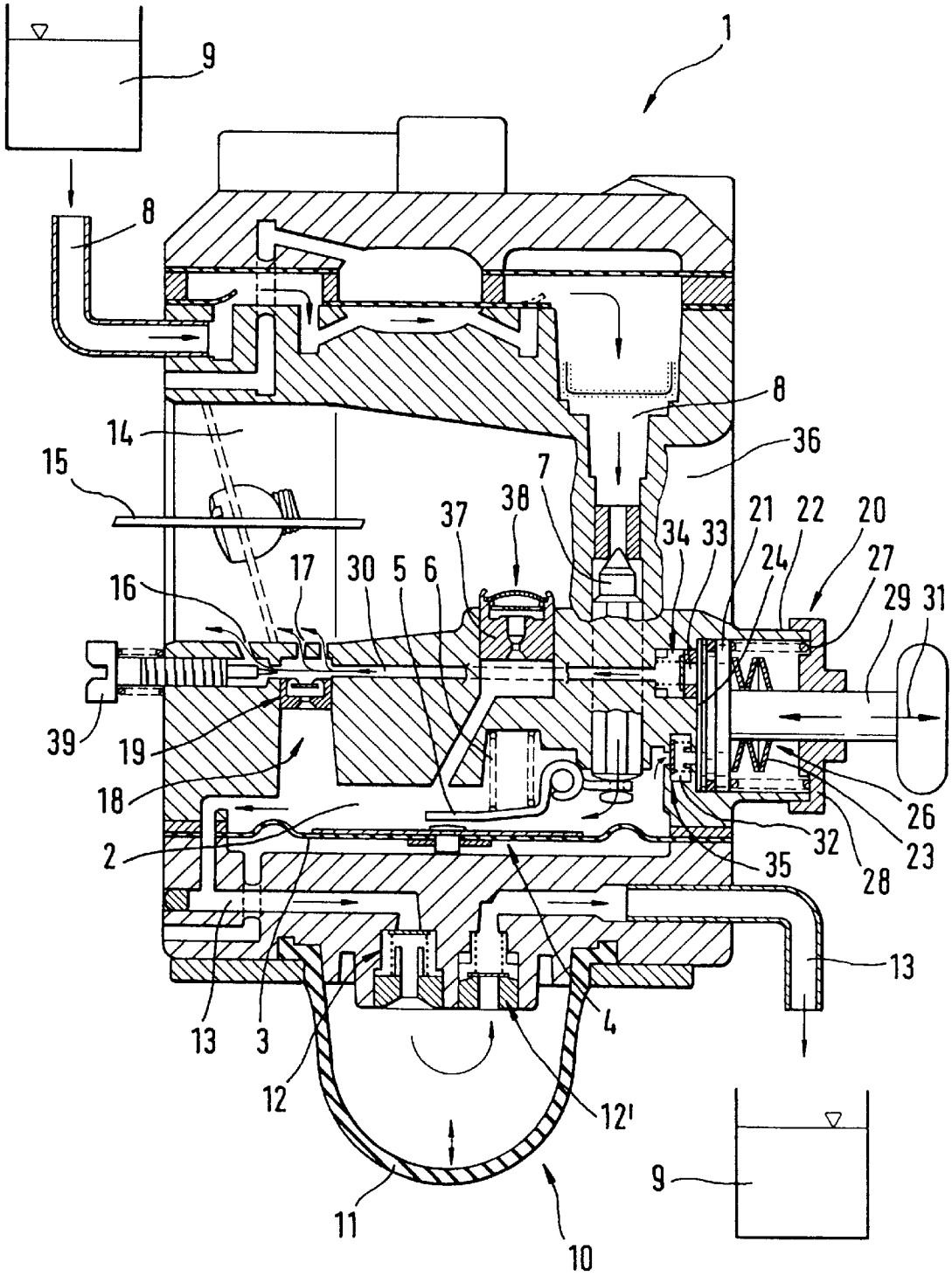

Referring to FIG. 1, the membrane carburetor 1 functions to prepare the mixture for an internal combustion engine (not shown) for driving a work tool in a portable handheld work apparatus such as a motor-driven chain saw, a cutoff machine or the like.

The membrane carburetor includes an air intake channel 14 to the engine. The metering of fuel into the intake air flow takes place in the region of a venturi section 36. During operation of the engine, fuel is emitted into the air flow through intake openings in the channel wall of the intake channel. For idle operation, intake openings (16, 17) are arranged in the region of a throttle flap 15 in the air intake channel 14. Intake openings 16 are downstream of the throttle flap 15 and intake openings 17 are upstream of the throttle flap 15 when the throttle flap is in the closed position shown in FIG. 1 in phantom outline. The intake opening 16 downstream of the throttle flap 15 can be closed by means of an adjusting screw 39. A check valve 19 is arranged in the feed 18 of the intake openings (16, 17). A main nozzle 37 for emitting additional fuel during the normal operation of the engine is arranged in the region of the venturi section 36. The feed of the main nozzle is likewise provided with a check valve 38.

The feed 18 of the intake openings (16, 17) and also the main nozzle 37 are all fed from a control chamber 2 which is delimited by a membrane 3. The membrane 3 is supported by a membrane plate 4 which coacts with a valve pin 7 via a lever 5. The valve pin 7 controls a feed line 8 from the fuel tank 9. A reference pressure, for example, atmospheric pressure is applied to the side of the membrane facing away from the control chamber 2. When there is underpressure in the control chamber 2, the membrane is deflected against the return force of a spring 6 acting on the lever 5 and the valve pin 7 is actuated. The return force of the spring 6 determines the opening pressure of the membrane valve.

The membrane carburetor 1 includes a scavenging pump 10 and an injection pump 20 for outputting a predetermined fuel start quantity in order to ensure a reliable start and a reliable runup of the engine. With the scavenging pump 10, the control chamber 2 is first to be flooded with fuel in advance of the start of the engine. The scavenging pump 10 is mounted in a return line 13 from the control chamber 2 to the fuel tank 9 and includes an elastic bellows 11 as an actuating element. The bellows 11 can be pressed inwardly and has approximately a semi-spherical shape. To flood or purge the control chamber 2, the bellows 11 is pressed inwardly by an operator and when the bellows 11 elastically resumes its shape, an underpressure is introduced in the control chamber 2 which enables or clears the feed line 8 to the control chamber 2 by deflecting the membrane 3. The pump action of the bellows 11 is ensured by an arrangement of the check valves (12, 12') which permit only a through-flow in the direction toward the fuel tank 9.

The injection pump 20 includes a displacement piston 21 which is longitudinally guided in a cylinder 22 of the pump 20 and delimits a pump chamber 24. The cylinder 22 is covered at the end thereof which faces toward the pump chamber 24 by a cylinder head 28. An actuating rod 29 passes through the cylinder head 28 and carries a displacement piston 21 at its free end within the cylinder 22. The inlet 32 of the injection pump 20 to the pump chamber 24 lies in the control chamber 2 and is enabled by a check valve 35 during the suction stroke of the displacement piston 21 to fill the pump chamber 24.

The rod 29 with the displacement piston 21 is movable back and forth in the axial direction of the cylinder and the piston stroke 31 determines the volume of the pump chamber 24. The piston stroke 31 is limited by a stop 26. The stop 26 is formed by a spring packet 23 of bimetal plate springs which have an annular shape and surround the rod 29 and are arranged between the cylinder head 28 and the back side of the displacement piston 21. The bimetal plate spring packet 23 limits the intake stroke of the displacement piston 21 in dependence upon its temperature and the axial expansion assumed thereby within the cylinder 22. The plate spring element, which lies facing toward the cylinder head 28, forms the stop 26 and, at the end of the piston stroke, the plate spring element comes into contact engagement against the cylinder head 28. With the actuation of the injection pump 20 by pulling out the rod 29, a suction stroke is provided up to the stop of the plate springs against the cylinder head 28. The plate spring packet 23 determines the pump chamber volume and therefore the priming fuel quantity provided for injection into the carburetor.

A return spring 27 operates on the displacement piston 21 and brings about the pump stroke when the valve rod 29 is released by the operator. The pump chamber 24 and the priming fuel quantity disposed therein are pressed out by the displacement piston through an outlet 33 into an injection line 30. A check valve 34 is mounted in the outlet 33. With the injection pump 20 configured in accordance with the invention, the priming fuel quantity is metered accurately and in correspondence to the ambient temperature and can be manipulated easily by an operator (pulling out the rod up to the stop).

The injection line 30 opens downstream of the check valve 19 into the feed of the idle intake openings (16, 17). With priming, the fuel, which is pressed to the intake openings (16, 17), wets the valve member of the check valve 19 so that a sticking of the valve member to its valve seat in a subsequent start of the engine is precluded. Especially with a disc-shaped configuration of the closure members of the check valve, the damaging action of sticking can be countered by the two-sided wetting with the fuel. The disc-shaped configuration is advantageous because of the low opening pressure. The above-mentioned sticking occurs during the standstill phases of the engine and often cannot be avoided.

It is understood that the foregoing description is that of the preferred embodiments of the invention and that various changes and modifications may be made thereto without departing from the spirit and scope of the invention as defined in the appended claims.

What is claimed is:

1. A membrane carburetor for an internal combustion engine including an engine for a portable handheld work apparatus, the engine including a fuel tank, a fuel feed line connected to the tank and a fuel return line also connected to said tank, the membrane carburetor comprising:

a carburetor housing defining an air-intake channel communicating with the engine and through which a stream of air flowing in an intake direction is drawn by suction when the engine is operating;

said carburetor housing including a control chamber connected to said fuel-feed line and to said return line;

a membrane arranged in said carburetor housing and mounted therein so as to delimit said control chamber;

a valve assembly operatively connected to said membrane for clearing said fuel feed line in response to a deflection of said membrane in response to an underpressure in said control chamber;

an intake passage for connecting said control chamber to said air-intake channel and for conducting fuel thereto;

said intake channel including outlet means opening into said air-intake channel;

a check valve mounted in said intake passage;

a scavenging pump defining a first start-assist device and being connected in said fuel return line between said control chamber and said fuel tank;

an injection pump defining a second start-assist device;

said injection pump including: a cylinder and a displacer piston delimiting a pump chamber into which fuel can flow;

an injection line connecting said pump chamber to said intake passage;

said displacer piston being longitudinally movable in said cylinder through a piston stroke for pumping fuel in said pump chamber through said injection line, said outlet means and into said air-intake channel;

said injection pump further including: a stop for limiting said piston stroke; and, an adjusting element having a shape changing in dependence upon temperature to determine the length of said piston stroke.

2. The membrane carburetor of claim 1, wherein said adjusting element is a bimetal element.

3. The membrane carburetor of claim 2, said displacer piston including a free end facing away from said pump chamber; said stop being configured as a cylinder head covering said cylinder; said injection pump further including a rod extending through said cylinder head and mounted on said free end of said displacer piston; and, said bimetal element being mounted between said cylinder head and said displacer piston so as to be expandable in the direction of said piston stroke.

4. The membrane carburetor of claim 3, wherein said bimetal element comprises a plate spring packet having a plurality of bimetal plates arranged one behind the other.

5. The membrane carburetor of claim 4, wherein said pump chamber communicates with said control chamber to permit said pump chamber to be filled with fuel from said control chamber.

6. The membrane carburetor of claim 5, said injection pump including an inlet communicating with said control chamber and an outlet connected to said injection line; and, first and second check valves mounted in said inlet and said outlet, respectively.

7. The membrane carburetor of claim 1, said injection line opening into said intake passage next to and downstream of said check valve mounted in said intake passage.

8. The membrane carburetor of claim 7, further comprising a throttle flap pivotally mounted in said air-intake channel; and, said outlet means being supplied by fuel from said injection pump and being disposed in the region of said throttle flap.

9. The membrane carburetor of claim 1, said displacer piston being movable through an intake stroke; and, said injection pump including a return spring and said stop functioning to limit said intake stroke.

10. The membrane carburetor of claim 1, said scavenging pump including an elastic depressable pump bellows.

* * * * *